US012194337B2

(12) United States Patent
Leavitt

(10) Patent No.: US 12,194,337 B2
(45) Date of Patent: Jan. 14, 2025

(54) HYDROTHERAPY TREADMILL

(71) Applicant: Douglas F. Leavitt, Bethlehem, PA (US)

(72) Inventor: Douglas F. Leavitt, Bethlehem, PA (US)

( * ) Notice: Subject to any disclaimer, the term of this patent is extended or adjusted under 35 U.S.C. 154(b) by 118 days.

(21) Appl. No.: 18/143,796

(22) Filed: May 5, 2023

(65) Prior Publication Data

US 2024/0366996 A1 Nov. 7, 2024

(51) Int. Cl.
*A63B 22/02* (2006.01)
*A63B 21/008* (2006.01)

(52) U.S. Cl.
CPC ..... *A63B 22/0264* (2015.10); *A63B 21/0083* (2013.01); *A63B 2220/36* (2013.01); *A63B 2220/833* (2013.01); *A63B 2225/50* (2013.01); *A63B 2225/60* (2013.01)

(58) Field of Classification Search
CPC ..... A63B 22/0264; A63B 21/0083; A63B 2220/36; A63B 2220/833; A63B 2225/50; A63B 2225/60
See application file for complete search history.

(56) References Cited

U.S. PATENT DOCUMENTS 4,576,376 A * 3/1986 Miller ..... A63B 22/02 482/111
4,712,788 A * 12/1987 Gaudreau, Jr. ..... A63B 22/02 4/496
4,776,581 A * 10/1988 Shepherdson ..... A63B 22/02 D24/188
4,918,766 A * 4/1990 Leonaggeo, Jr. ..... A63B 22/02 482/4
5,102,380 A * 4/1992 Jacobson ..... A63B 22/02 482/111
5,111,127 A * 5/1992 Johnson ..... H01M 50/296 320/101

(Continued)

FOREIGN PATENT DOCUMENTS

CN 208436318 U 1/2019
CN 208741838 U 4/2019

(Continued)

*Primary Examiner* — Andrew S Lo
(74) *Attorney, Agent, or Firm* — James R. McDaniel

(57) ABSTRACT

The invention provides a hydrotherapy treadmill. The treadmill comprises a treadmill main body including a treadmill belt, submerged in a water body, mounted on a support rack having a first and a second longitudinal side rails; a base frame configured to mount the support rack and the treadmill belt; and a first roller and a second roller rotatably mounted on the support rack and positioned between and substantially perpendicular to said first and second longitudinal side rails. The treadmill belt is an endless belt mounted around and extending between said first roller and the second roller for rotation therewith. The hydrotherapy treadmill further comprises a transmission system comprising an electrically powered hydraulic pump, wherein the electrically powered hydraulic pump rotates a hydraulic motor of the treadmill belt via a hydraulic input hose and a hydraulic output hose connected to the treadmill main body; and the hydraulic pump is powered by plugging, into a 120-volt power supply, a cord of a portable power unit mounted on a rolling cart.

20 Claims, 8 Drawing Sheets

(56) References Cited

U.S. PATENT DOCUMENTS

| | | | | | |
|---|---|---|---|---|---|
| 5,123,641 | A * | 6/1992 | Abboudi | A63B 21/00069 416/54 |
| 5,558,604 | A * | 9/1996 | Hopkins | A63B 22/0264 482/111 |
| 5,921,892 | A * | 7/1999 | Easton | A63B 22/02 482/54 |
| 6,045,490 | A | 4/2000 | Shafer et al. | |
| 8,784,278 | B2 * | 7/2014 | Flake | A61H 33/6026 482/54 |
| 11,957,954 | B2 * | 4/2024 | Remsberg | A61B 5/1123 |
| 2001/0051563 | A1 | 12/2001 | Turak et al. | |
| 2011/0294625 | A1 * | 12/2011 | Flake | A61H 33/0087 482/54 |
| 2022/0305329 | A1 * | 9/2022 | McHugh | A63B 22/0235 |

FOREIGN PATENT DOCUMENTS

| | | | | | |
|---|---|---|---|---|---|
| CN | 111408100 | A | * | 7/2020 | |
| GB | 2415393 | A | | 12/2005 | |
| WO | WO-9533525 | A1 | * | 12/1995 | A63B 22/02 |
| WO | WO-9604963 | A1 | * | 2/1996 | A63B 21/00061 |
| WO | WO-2013149353 | A2 | * | 10/2013 | A61G 7/1005 |

* cited by examiner

HYDROTHERAPY TREADMILL

FIELD OF THE INVENTION

The present invention relates generally to an exercise and therapy apparatus and more particularly to a kind of underwater treadmills.

BACKGROUND OF THE INVENTION

Background description includes information that may be useful in understanding the present invention. It is not an admission that any of the information provided herein is prior art or relevant to the presently claimed invention, or that any publication specifically or implicitly referenced is prior art.

Running is one of the most commonly used physical training exercises for people. It can enhance physique; exercise cardiopulmonary functions, does not need any instruments, and has no strict requirements on site. The underwater running is also an exercise mode, and due to the buoyancy of the water, the gravity borne by the body is reduced, and the compression of the joint is greatly reduced accordingly so that the damage of the running to each joint of the leg is effectively reduced. Underwater running is also a very suitable restorative exercise measure for joints or muscle injuries. Many professional athletes use a cross-training mode such as underwater running. Also, underwater running On the other hand, the resistance of the water greatly exceeds the resistance of the air, and the consumed heat is also greatly increased, which is very suitable for people who lose weight.

A hydrotherapy treadmill is a running or walking treadmill that is used in the water to provide mobility and exercise for a patient or participant allowing buoyancy to reduce the amount of stress to the participants' knees and ankles. The treadmill is driven by an electrically powered hydraulic pump housed up and out of the pool which rotates a motor via hydraulic input and output hydraulic hoses.

Hydrotherapy or aquatic therapy treadmills are used in therapy pools, swim spas, and offer low-impact, high-resistance low impact workouts for both humans and animals. Further, also used in sports and healthcare. Large pools, freestanding units, and plunge pools are used in rehabilitation and exercise.

CN208741838U provides a kind of hydraulic-driven underwater treadmills, including a transmission system and treadmill main body. The transmission system includes a hydraulic pump, hydraulic motor, and treadmill main body includes a rack and treadmill belt. When the underwater treadmill is in operation, the hydraulic motor, rack, and treadmill belt are immersed in the water, and underwater portion is mechanical transmission component. Further, the rack is equipped with a hollow cylinder, and hollow cylinder both ends are sealed protection by a bearing and mechanical sealing member, it, therefore, prevents the oil leakage which pollutes the water and also increases the service life.

CN208436318U relates to a kind of underwater treadmills, including water-powered system and sub-aqua sport system. The water-powered system includes hydraulic station, hydraulic oil transfer canal; the sub-aqua sport system includes transmission shaft, couple axle and treadmill belt; the hydraulic station is connect with the transmission shaft by the hydraulic oil transfer canal, and the transmission shaft is connect with the couple axle by the treadmill belt. The transmission shaft includes center-pole, spiral stirring cage, rotational shell and 2 containment members. The containment member is sealingly engaged with the center-pole outer wall, constitutes oil pressure chamber with the center-pole and rotational shell.

U.S. Pat. No. 5,558,604A relates to an underwater treadmill apparatus which is made up of a treadmill belt trained over a drive roller and take-up roller, a fluid drive motor and flywheel coupled to a common drive shaft in direct driving relation to the drive roller, and an isolated power source outside of the body of water includes an electric motor-driven hydraulic pump to direct hydraulic fluid under pressure to the hydraulic drive motor. The upper course of the treadmill belt advances over a rigid deck having an upper cushion layer with raised straddle portions on each side, and the take-up roller is resiliently mounted at one end of the deck. A bonding grid break and sacrificial anodes are provided to inhibit corrosion, and the treadmill frame can be placed in compressible padding and be leveled from a point above the surface of the water, for example, when placed in a swimming pool.

U.S. Pat. No. 6,045,490A discloses a motorized treadmill that provides more fluid rotational motion of the treadmill belt, increases the life of the motor, provides more stable and reliable elevation of the treadmill, and provides automatic dampening for users of all weight ranges. The treadmill includes an external frame having first and second longitudinal side rails and at least one frame cross-bar extending therebetween, and an upright frame section that extends upwardly from a first end of the longitudinal side rails. First and second rollers are rotatably mounted on the external frame and positioned so as to be substantially perpendicular to the longitudinal side rails. The first roller is coincident with a first axis. A deck is mounted on the external frame and positioned between the first and second rollers and the longitudinal side rails. An endless belt is mounted around and extends between the first and second rollers for rotation therewith. A motor assembly including a motor, and a motor shaft that is coincident with a second axis and is rotatably driven by the motor, is rotatably coupled to the first roller for rotatably driving the first roller.

US20010051563A1 discloses a combination single unit hydrotherapy and exercise device is disclosed, for allowing aquatic exercise, massage, therapy and recreation, including any one of swimming, walking or running in place, comprised of a single seamless plastic enclosure having two ends and bottom there between an open top opposite the bottom, said top defining an outer perimeter sufficiently long and wide to allow a swimmer to swim in place, and having steps at one end as part of the single seamless enclosure to allow access from the top to the bottom where the bottom is sufficiently deep to allow an adult to stand in water at chest high, a shaft receiving hole near the bottom of the enclosure. Control buttons and safety stop buttons means at the top of the enclosure, a treadmill having a frame and a treadmill belt moved by a rotationally moving roller and shaft, said shaft extending from the treadmill to exit the wall of the enclosure through the shaft hole for connecting to exterior rotational motor means, said treadmill having a variable speed responsive to the control buttons, sealing means to seal the shaft exit hole about the shaft, swim jets at the front end of the enclosure and having means for providing sufficiently powerful water flow from the front to the back of the enclosure so as to provide sufficient resistance to allow swimming in place, a treadmill receiving cavity at the bottom having a depth approximately the height of the treadmill and defining from an area on at least three sides of the cavity to constitute a safety step off area.

A freestanding underwater treadmill allows versatility in that it can be removed for other functions being performed in those pools. Smaller therapy pools are becoming more popular in physical therapy, wellness and fitness centers. Hydrotherapy pools are smaller typically heated and have become prevalent in physical therapy and exercise facilities which require multiple uses of these pools. There could be and Aqua aerobics class one day, a physical therapy session the next and the pool should be available for open use in general.

Freestanding underwater treadmills are placed in an existing pool. They are driven by an electrically powered hydraulic pump called a power pack, housed up and out of the pool which rotates a motor at the treadmill via input and output hydraulic hoses. This eliminates the risk of electric shock by separating the motor from the water.

Further, there are treadmills with their own tanks which can be filled and drained with each use and comprise most of the market. The price of such treadmills ranges between $80,000-$120,000 and higher depending on the complexity of the tank.

The existing treadmills require an existing pool. They are both powered by a hydraulic pump stationed in a utility room which is powered by 220-volt electric current. The treadmill motor is mounted to the frame of the treadmill and there is a tether comprising an output hydraulic hose from the pump and return line, the motor turns at a given torque and speed based on the flow rate and pressure of hydraulic fluid flowing through the motor. The electrically driven pump is out of the water to avoid proximately to the water for safety purposes.

A good runner using a hydrotherapy treadmill will exert little downward force on a treadmill whereas a heavier person walking or standing on a treadmill exerts a large downward force, requiring larger amounts of torque or higher flow rate/pressure of the hydraulic fluid.

A large person walking slowly on a treadmill creates downward loads of several hundred pounds which may range between 400-600 pounds. The increased resistance of water decreases the speed achieved on the treadmill with an advanced athlete being capable of running 5-8 MPH as an estimate. An average person will reach speed of 1-1.7 MPH on the treadmill.

Current products advertise being capable of moving the surface of the belt at 5 MPH requiring a large amount of torque which is transferred through the rollers to drive the tread without sticking or stopping as the user's feet drive down on the surface of the belt.

With current hydrotherapy treadmills, large motors with direct drives to the treadmill roller require a high flow rate and pressure of hydraulic fluid running through the hydraulic motor. The power unit used for running such treadmills is a 220-volt power source which is subsequently placed in pump rooms where that power source is available.

220-volt electric lines are generally limited to pump rooms. Installing a 220-volt line is at least $2,000 and would not be considered to be available on a wall at the side of a pool. This is limiting in terms of where the treadmill can be placed as a tether is also required. Moreover, 220 V wall outlets are not available in any pool environment.

Also, the current freestanding treadmills are large, heavy, and not easily movable in and out of the pool and not mobile. Removing the existing treadmills from a pool requires several people or equipment to lift it out from the pool.

Therefore, there is a need for an improved and efficient hydrotherapy treadmill which is able to overcome the above-mentioned limitations.

The present application provides these and other advantages as will be apparent from the following detailed description and accompanying figures.

SUMMARY OF THE INVENTION

To address the foregoing problems, in whole or in part, and/or other problems that may have been observed by persons skilled in the art, the present disclosure provides compositions and methods as described by way of example as set forth below.

An object of the present invention is to provide an improved and efficient hydrotherapy treadmill which is compatible with 120 V power supply and consumes less power.

Another object of the present invention is to provide a hydrotherapy treadmill which consumes less space and is user-friendly.

Another object of the present invention is to provide a hydrotherapy treadmill having a simple construction and which is less expensive.

Another object of the present invention is to provide a hydrotherapy treadmill which is easier and safer to remove out of the pool.

Another object of the present invention is to provide a hydrotherapy treadmill which is easier and safer to remove out of the pool.

Another object of the present invention is to provide a hydrotherapy treadmill which is compact and light weight and can be removed out of the pool by less number of people.

In accordance with the embodiment of the present invention, there is provided a hydrotherapy treadmill. The treadmill comprises a treadmill main body including a treadmill belt, submerged in a water body, mounted on a support rack having a first and a second longitudinal side rails, a base frame configured to mount the support rack and the treadmill belt, and first and second rollers rotatably mounted on the support rack and positioned between and substantially perpendicular to said first and second longitudinal side rails. The treadmill belt is an endless belt mounted around and extending between said first and second rollers for rotation therewith. The treadmill further comprises a transmission system comprising an electrically powered hydraulic pump, wherein the electrically powered hydraulic pump rotates a hydraulic motor of the treadmill belt via a hydraulic input and output hose connected to the treadmill main body; and the hydraulic pump is powered by plugging a cord of a portable power unit mounted on a rolling cart into a 120-volt power supply.

Additional features of the invention will be or will become apparent to one with skill in the art upon examination of the following figures and detailed description. It is intended that all such additional features and advantages be included within this description, be within the scope of the invention, and be protected by the accompanying claims.

BRIEF DESCRIPTION OF THE DRAWINGS

Figure 1:
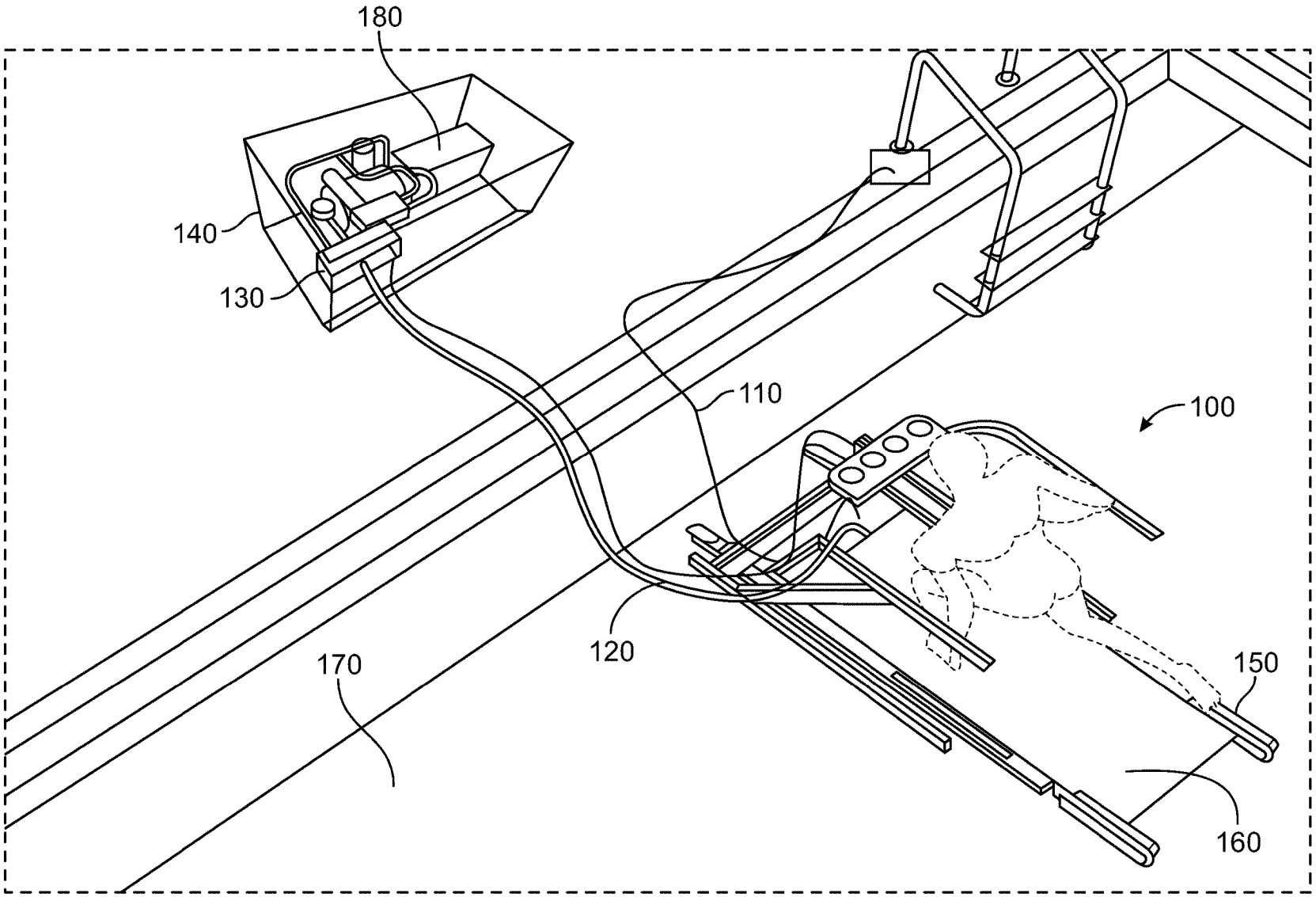
Figure 2:
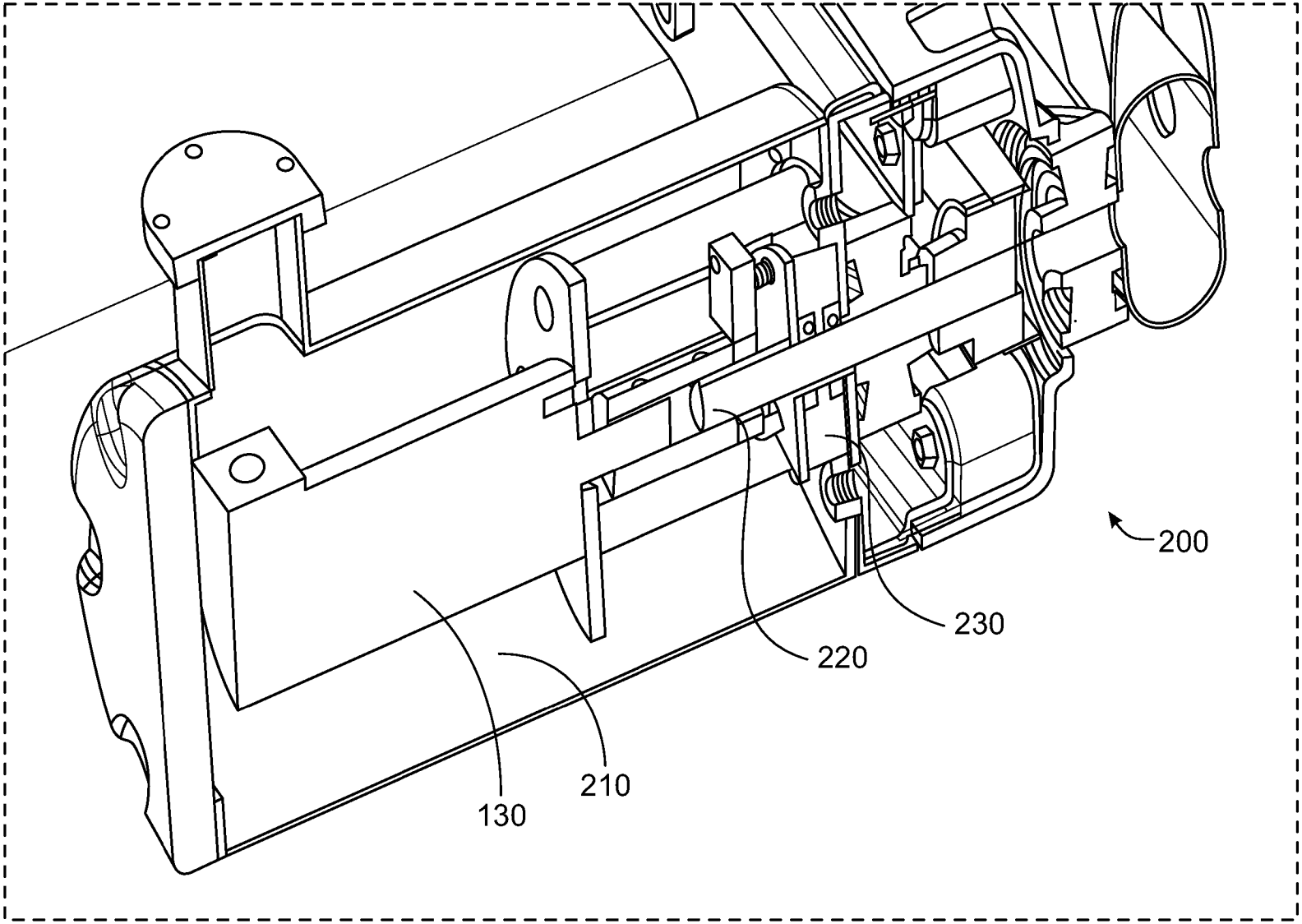
Figure 3A:
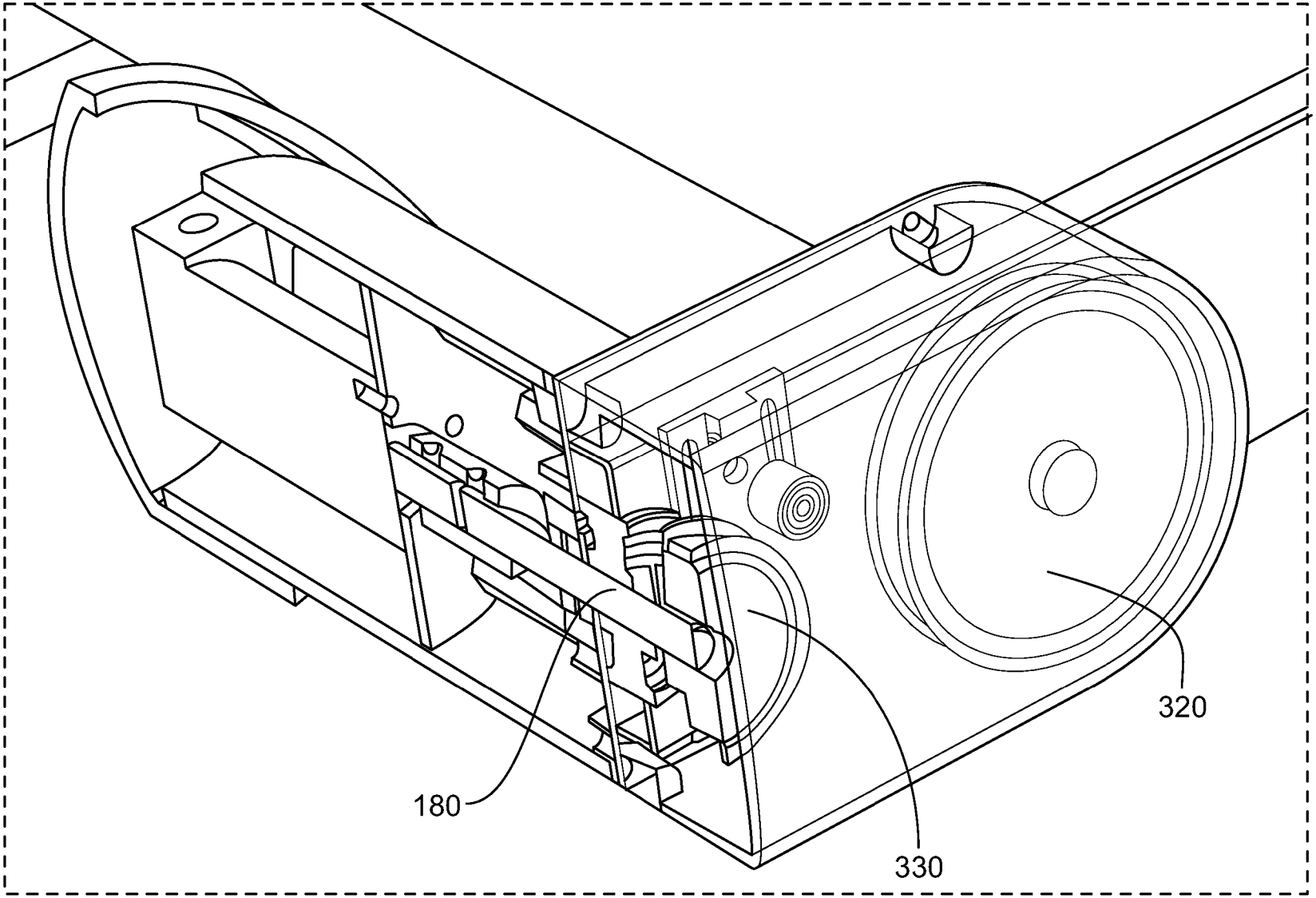
Figure 3B:
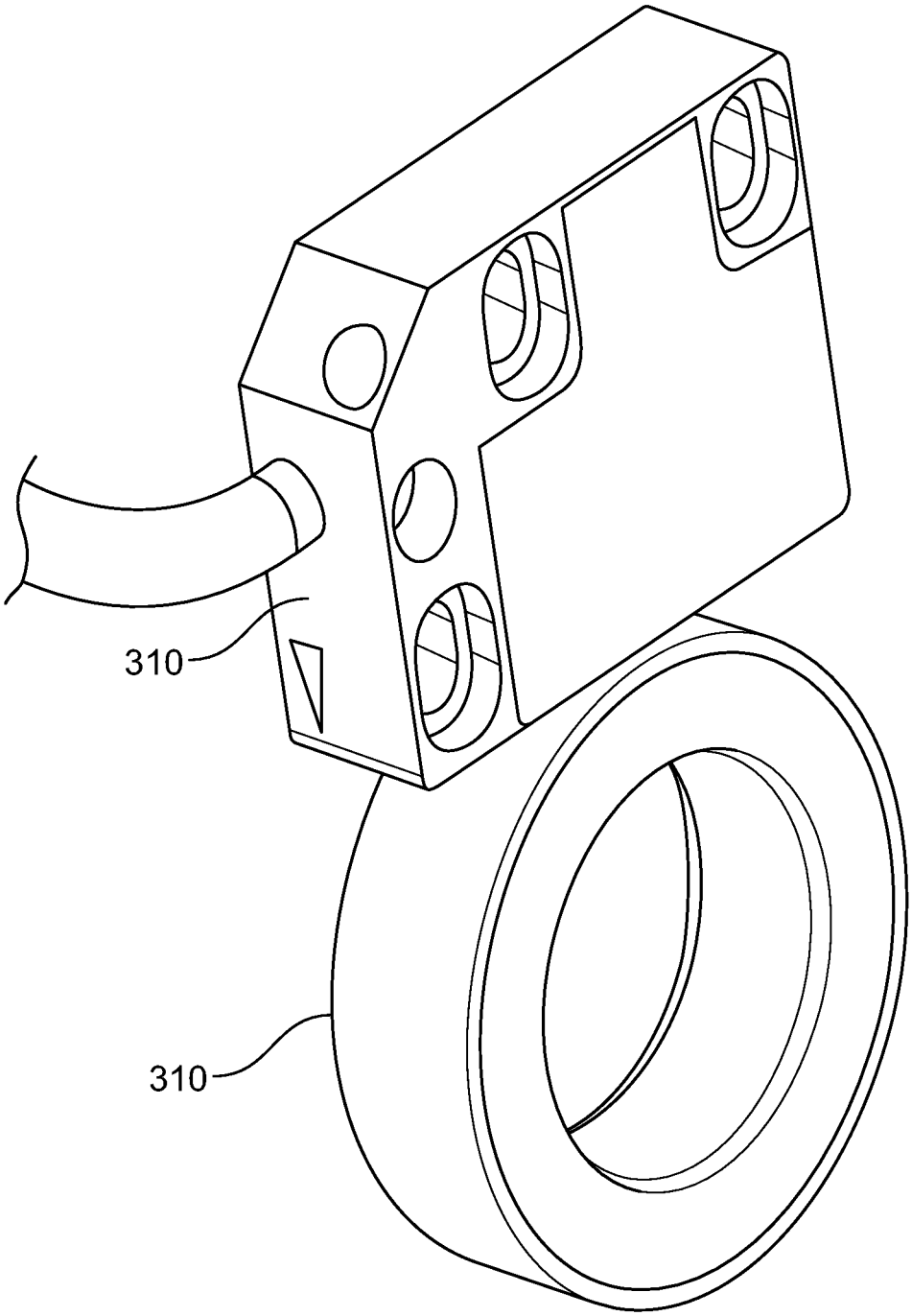
Figure 4:
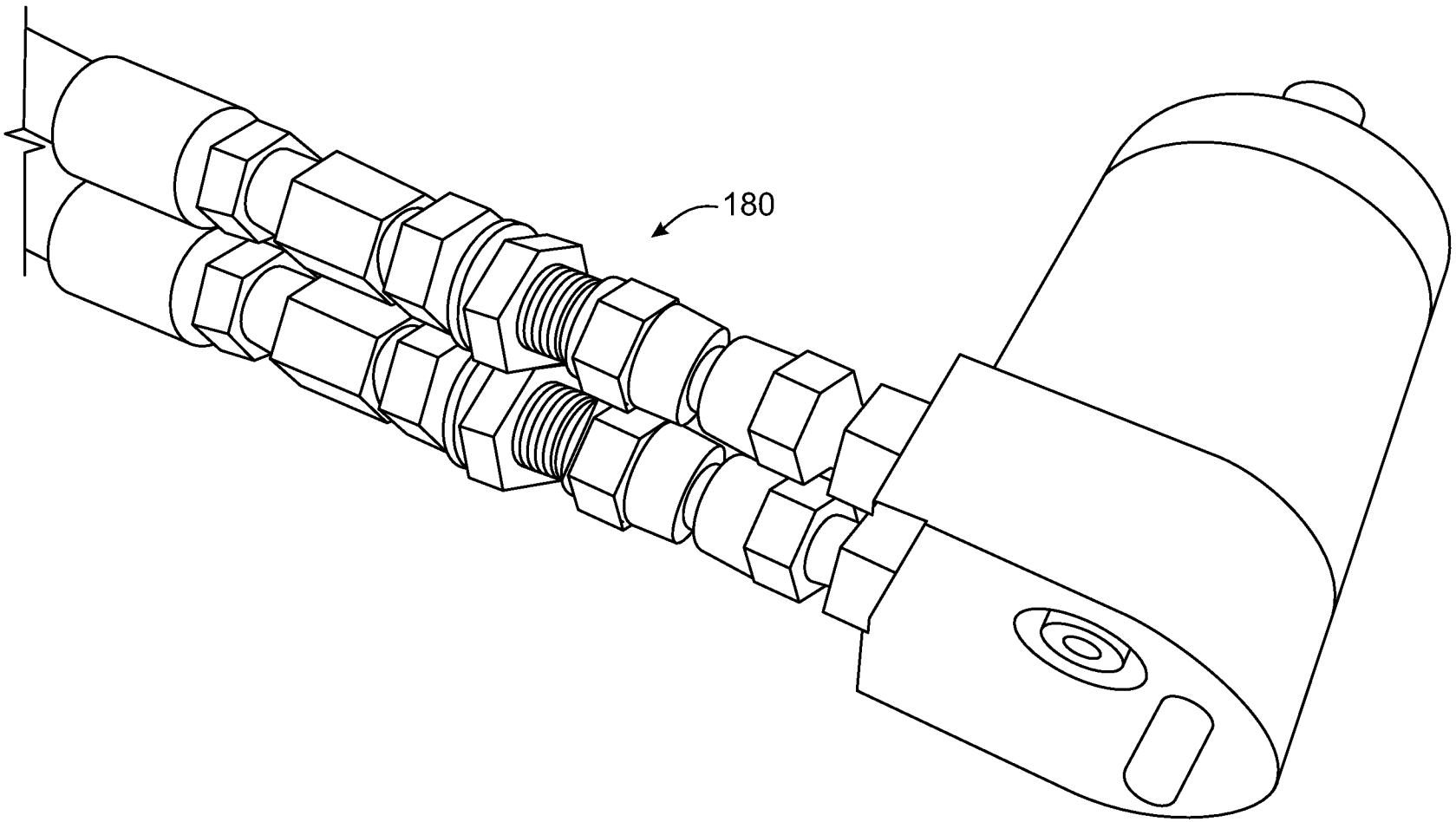
Figure 5A:
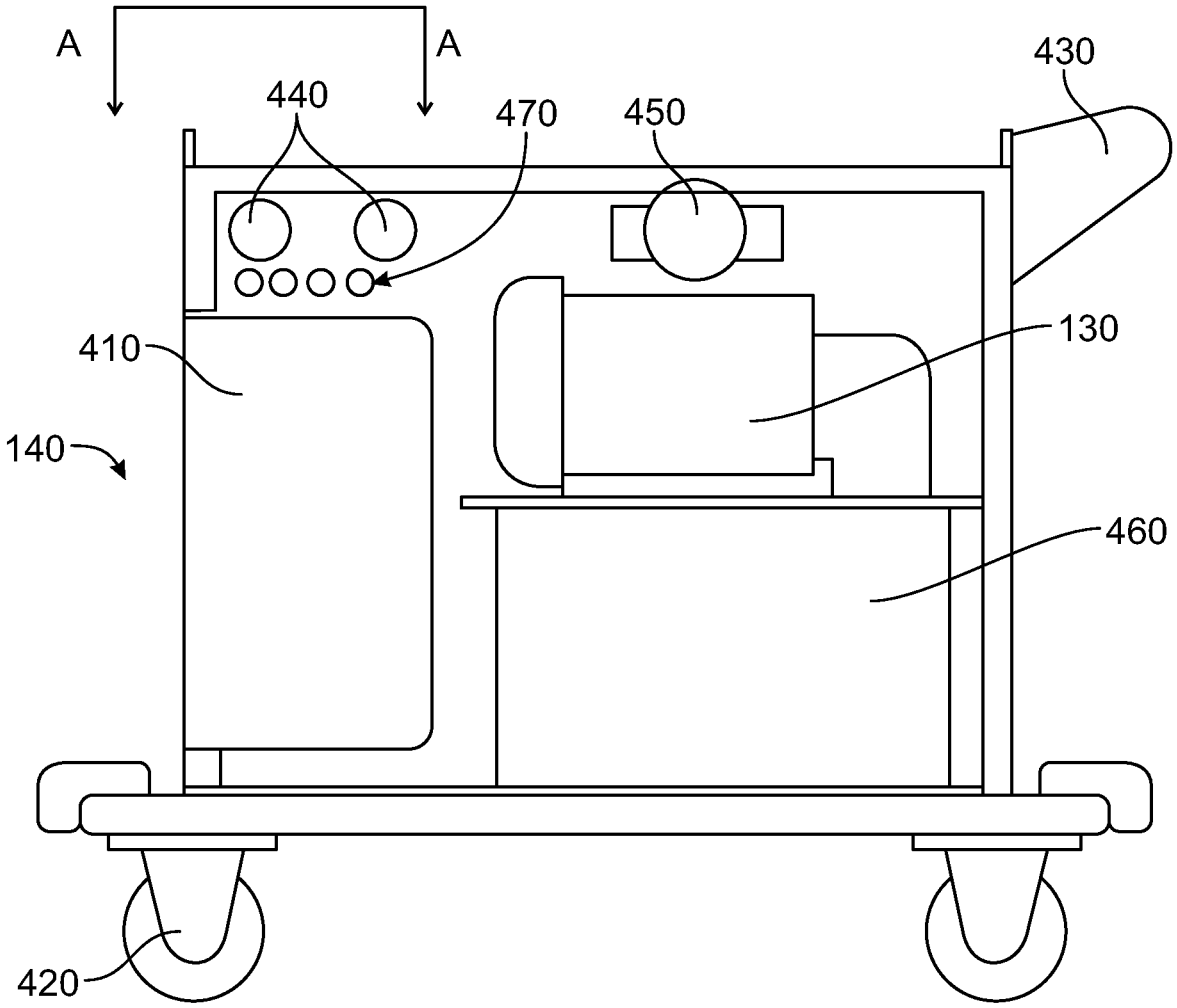
Figure 5B:
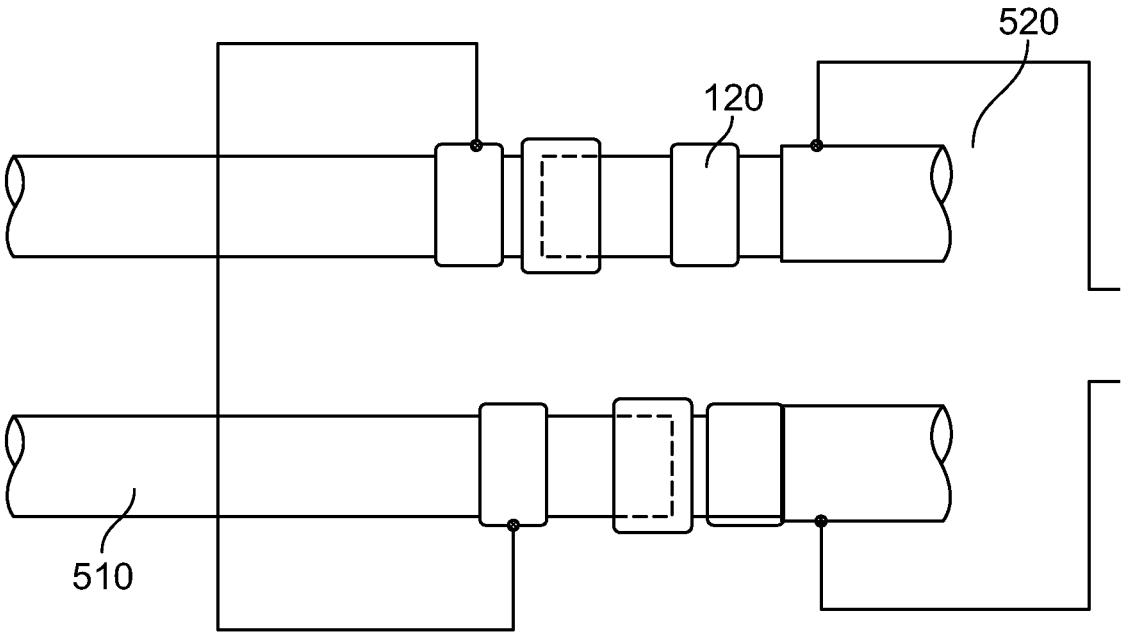
Figure 6:
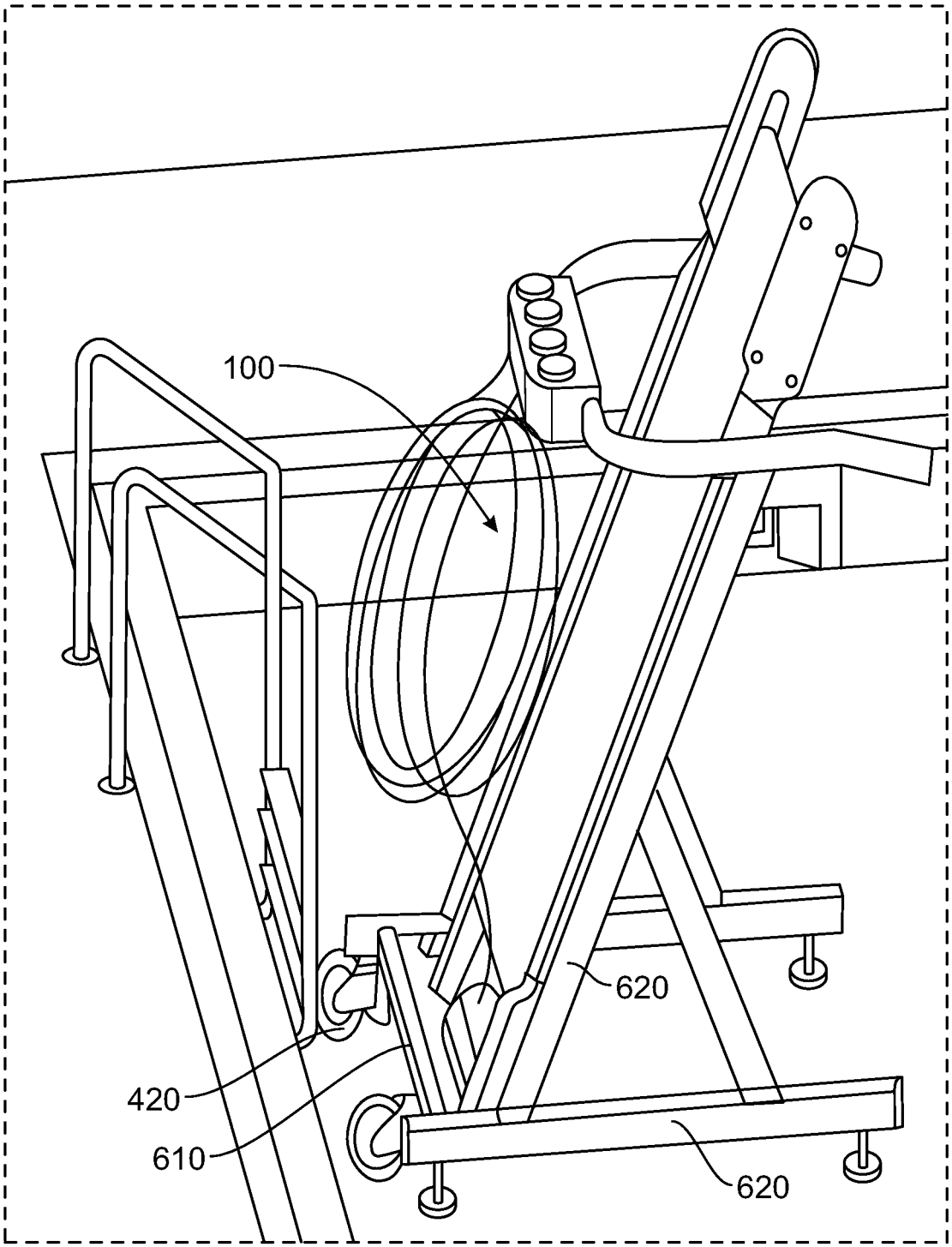

Having thus described the subject matter of the present invention in general terms, reference will now be made to the accompanying drawings, which are not necessarily drawn to scale, and wherein:

FIG. 1 illustrates a schematic view of the physical layout of the hydrotherapy treadmill in the pool, in accordance with an embodiment of the present invention;

FIG. 2 illustrates a schematic view of an enclosure of a hydraulic motor of the hydrotherapy treadmill, in accordance with an embodiment of the present invention;

FIG. 3A illustrates a schematic internal view of the hydraulic motor, in accordance with an embodiment of the present invention;

FIG. 3B illustrates a schematic view of a sensor mounted on a ring with a magnetic outer shell fixed to the rotating shaft, in accordance with an embodiment of the present invention;

FIG. 4 illustrates a schematic back view of the hydraulic motor, in accordance with an embodiment of the present invention;

FIG. 5A illustrates a schematic view of the portable power unit mounted on a rolling cart, in accordance with an embodiment of the present invention;

FIG. 5B illustrates a schematic cross sectional view of the portable power unit mounted on a rolling cart, and FIG. 6 illustrates a schematic view of the folded hydrotherapy treadmill, in accordance with an embodiment of the present invention;

Skilled artisans will appreciate that elements in the drawings are illustrated for simplicity and may not have necessarily been drawn to scale. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION OF THE INVENTION

The subject matter of the present invention now will be described more fully hereinafter with reference to the accompanying drawings, in which some, but not all embodiments of the subject matter of the present invention are shown. Like numbers refer to like elements throughout. The subject matter of the present invention may be embodied in many different forms and should not be construed as limited to the embodiments set forth herein; rather, these embodiments are provided so that this disclosure will satisfy applicable legal requirements. Indeed, many modifications and other embodiments of the subject matter of the present invention set forth herein will come to mind to one skilled in the art to which the subject matter of the present invention pertains having the benefit of the teachings presented in the foregoing descriptions and the associated drawings. All illustrations of the drawings are for the purpose of describing selected versions of the present invention and are not intended to limit the scope of the present invention. Therefore, it is to be understood that the subject matter of the present invention is not to be limited to the specific embodiments disclosed and that modifications and other embodiments are intended to be included within the scope of the appended claims.

The term "some" as used herein is to be understood as "none or one or more than one or all." Accordingly, the terms "none," "one," "more than one," "more than one, but not all" or "all" would all fall under the definition of "some." The term "some embodiments" may refer to no embodiments or to one embodiment or to several embodiments or to all embodiments, without departing from the scope of the present disclosure.

The terminology and structure employed herein is for describing, teaching, and illuminating some embodiments and their specific features. It does not in any way limit, restrict or reduce the spirit and scope of the claims or their equivalents.

More specifically, any terms used herein such as but not limited to "includes," "comprises," "has," "consists," and grammatical variants thereof do not specify an exact limitation or restriction and certainly do not exclude the possible addition of one or more features or elements, unless otherwise stated, and furthermore must not be taken to exclude the possible removal of one or more of the listed features and elements, unless otherwise stated with the limiting language "must comprise" or "needs to include."

Whether or not a certain feature or element was limited to being used only once, either way, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language such as "there needs to be one or more." or "one or more element is required."

Unless otherwise defined, all terms, and especially any technical and/or scientific terms, used herein may be taken to have the same meaning as commonly understood by one having ordinary skills in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfill the requirements of uniqueness, utility, and non-obviousness.

The present invention provides an improved hydrotherapy treadmill which is submerged inside a pool. The treadmill of the present invention is compact and is provided with a folding provision. There is gearing going from a smaller at the motor to larger at the drive roller, allowing the treadmill to meet torque requirements at a slower speed, using less power and allowing the use of a 120-V power supply.

Further, the disclosed treadmill is compatible with 120 V power supply where the power unit of the treadmill is placed on a rolling cart which can be easily moved from one location to another at the pool's deck. Hence, it can be easily moved to a place having 120 V power supply. The rolling cart carrying the power unit is in operable communication with the main body of the treadmill via a hydraulic input and output hose.

In an embodiment of the present invention, the main body of the treadmill is configured to fold into a portable configuration and a front portion of the base frame comprises at least two wheels configured to maneuver the hydrotherapy treadmill around the pool area.

The tether is disconnected at the power unit up on the pool deck, coiled up and hangs from the hand rail.

In an embodiment of the present invention, the treadmill comprises a plurality of cavities in the treadmill belt and the base frame. The plurality of cavities accommodates a plurality of closed-cell foam pieces configured to increase the buoyancy of the treadmill's main body. The increased buoyancy of the main body of the hydrotherapy treadmill assists in moving out the treadmill out of the water body.

In an another embodiment, the comprises a plurality of watertight cavities in the treadmill belt and the base frame configured to increase the buoyancy of the treadmill main body.

In an embodiment of the present invention, the treadmill comprises a tether having the hydraulic input and output hose connected to the treadmill's main body and a sensor cable connected to a processor configured to measure the speed of a user running on the hydrotherapy treadmill. The length of the tether ranges between 20-60 feet. The tether can be coiled up and supported on the treadmill main body. In an example, the sensor is a Hall effect sensor or an inductive sensor. A Hall effect sensor (or simply Hall sensor) is a type of sensor which detects the presence and magnitude of a magnetic field using the Hall effect. The output voltage of a Hall sensor is directly proportional to the strength of the field. Further, the inductive sensor consists of a bar magnet with a soft magnetic pole pin supporting an induction coil with two connections. Every time a ferromagnetic ring gear turns past this sensor, it generates a voltage in the coil which is directly proportional to the periodic variation in the magnetic flux. These sensors help in calculating the speed of the treadmill belt.

In an embodiment of the present invention, the sensor cable at one end comprises a hall effect sensor or an inductive sensor in communication with a ring having a magnetic outer shell that is fixed to a rotating shaft of the hydraulic motor of the treadmill belt.

In an embodiment of the present invention, the hydraulic motor is positioned inside a waterproof enclosure. Further, the first and second rollers are rotatably mounted on the support rack and are movably connected with a gear arrangement of the hydraulic motor configured to rotate the treadmill belt. There is provided a gear with a smaller diameter at the hydraulic motor shaft and a gear having a larger diameter on a driven roller. The gear ratio can be adjusted by using smaller and larger gears to achieve different torque/speed ratios.

In an embodiment of the present invention, the main body of the treadmill has a footprint of 32"×46". In the folded state, it consumes lesser space as compared to the conventional hydrotherapy treadmills. This facilitates in the easy storage of the treadmill.

In an embodiment of the present invention, the rolling cart of the portable power unit comprises a plurality of casters and a handle to maneuver the rolling cart around the pool area.

In an embodiment of the present invention, the rolling cart of the portable power unit comprises a hydraulic fluid reservoir for the hydraulic pump. The hydraulic pump is a hydraulic vane pump.

In an embodiment of the present invention, the main body of the treadmill comprises a plurality of control buttons and safety stop buttons for operating the treadmill speed using pneumatic tubes coupled to the tether, traveling back to the air actuating switches in the control unit.

In one embodiment, the switches at the treadmill are in a waterproof enclosure, powered by a small battery and communicate with the control unit via Bluetooth signals.

In accordance with an embodiment of the present invention, FIG. 1 illustrates a schematic view of the physical layout of the hydrotherapy treadmill in the pool. This figure shows the hydrotherapy treadmill 100 placed inside a water body 170. The hydrotherapy treadmill 100 is having a treadmill main body including a treadmill belt 160, submerged in the water body 170, mounted on a support rack having first and second longitudinal side rails 150. Further, the figure shows a base frame configured to mount the support rack and the treadmill belt 160. The first and second rollers (not shown in figure) are rotatably mounted on the support rack and positioned between and substantially perpendicular to the first and second longitudinal side rails. The treadmill belt 160 is an endless belt mounted around and extends between said first and second rollers for rotation therewith. Further, FIG. 1 shows a transmission system which comprises an electrically powered hydraulic pump 130, wherein the electrically powered hydraulic pump 130 rotates a hydraulic motor 180 of the treadmill belt 160 via a hydraulic input and output hose 120 connected to the treadmill main body at one end. The hydraulic pump 130 is powered by plugging, into a 120-volt power supply, a cord of a portable power unit mounted on a rolling cart 140.

In accordance with an embodiment of the present invention, FIG. 2 illustrates a schematic view of an enclosure of a hydraulic motor 180 of the hydrotherapy treadmill 100. It shows a waterproof enclosure 210 of the hydraulic motor 180. Further, it shows the hydraulic pump 130 in communication with a drive shaft 220 which is sealed by a shaft seal 230. The figure also shows a hydraulic input and output hose 120 connected to the treadmill's main body at one end and a speed. Also, there is provided a sensor cable 110 connected to a processor configured to measure the speed of a user running on the hydrotherapy treadmill 100. In an example, the sensor cable is connected to a hall effect sensor or an inductive sensor.

In one embodiment, the hydraulic motor is constructed of non-corrosive materials such as stainless steel, Aluminum, polypropylene and plastic and does not require a waterproof enclosure.

In accordance with an embodiment of the present invention, FIG. 3A illustrates a schematic view of the hydraulic motor 180. It shows a gearing going from a smaller 330 at the hydraulic motor 180 to larger 320 at the drive roller, allowing the treadmill to meet torque requirements at a slower speed, using less power and allowing the use of a 120-V power supply.

In accordance with an embodiment of the present invention, FIG. 3B illustrates a schematic view of the sensor 310 mounted on a ring with a magnetic outer shell fixed to the rotating shaft. The sensor 310 mounted on the ring fixed to the rotating shaft measures the speed of the treadmill belt 160, and communicates the same to a user interface. In one embodiment, the sensor 310 is packaged in its own waterproof enclosure. In an example, the sensor 310 is a hall effect sensor or an inductive sensor.

In an example, the hall effect sensor or the inductive sensor is connected to a 4-5 Volt power supply interfacing with an Arduino board housed in a portable power unit that is mounted on a rolling cart. The power would come from the Arduino board and travel through a cable tethered to the hoses and returns with the signal from the sensor. The Arduino board is in communication with an user interface electronic device, e.g., a laptop. The Arduino board may be customized anytime as per the requirement.

In an example, there is provided a hydraulic flow meter which is positioned outside the hydraulic piping. The hydraulic flow meter comprises a transmitter configured to provide output to an interface, wherein the interface could be an Arduino board which is in communication with an user interface electronic device, e.g., laptop.

In accordance with an embodiment of the present invention, FIG. 4 illustrates a schematic view of an enclosure of a hydraulic motor 180. The hydraulic motor 108 provides the torque that is required to drive the treadmill rollers and move the surface of the treadmill belt 160 at a desired speed. The hydraulic motor 180 is powered by a hydraulic pump 130, which is typically housed up and out of the pool to avoid proximity to the water for safety purposes. Moreover, the hydraulic motor 180 is positioned inside a waterproof enclosure 210.

In accordance with an embodiment of the present invention, FIG. 5A illustrates a schematic view of the portable power unit mounted on a rolling cart 140, in accordance with an embodiment of the present invention. The portable power unit corresponds to a portable power unit that is mounted on a rolling cart 140 and is used to power the hydraulic pump 130 that drives the hydraulic motor 180 of the treadmill, allowing it to operate in the water body 170. As a result, the portable power unit on a rolling cart 140 provides a versatile and convenient power source for hydrotherapy treadmills, allowing them to be used in a variety of locations and settings. The rolling cart 140 further comprises a handle 140 and casters 420 which facilitates a user to easily move the rolling cart 140 from one place to another on the pool deck. Also, there is provided a hydraulic fluid reservoir 460 for supplying the operating fluid to the portable power unit which powers the hydrotherapy treadmill 100. The electric controls 410 provide controls for operating the portable power unit. The inlet-outlet 440 provides connects the input-output hoses 120 to the portable power unit. Further, there is provided a proportional control valve 450 for controlling the various flows of the fluid in the system, and a plurality of pneumatic air control tube connections 470 for regulating the air flow.

In accordance with an embodiment of the present invention, FIG. 5B illustrates a schematic cross sectional view of the portable power unit mounted on a rolling cart 140. An electrical circuit 510 is built into the tether and enclosure connection such that when the hydraulic hoses 120 are connected, the circuit 510 is closed and the hydraulic motor 180 can be turned on. When either of the hydraulic hoses 120 is not connected, if the circuit 510 is open, the hydraulic motor 180 cannot be turned on. This prevents a buildup of pressure in the hydraulic line inside the power pack and causes the current draw to increase. The flow through the outbound and inbound tether allows the hydraulic pressure and current draw to remain at normal levels including full bypass or (stopped mode). The circuit is only a few inches long traveling back on the tether, just enough to loop back on the other line. The circuit 510 inside the power unit leads back to the controls. Further, the figure shows a circuit 520 which is directed to the controls of the power unit.

In accordance with an embodiment of the present invention, FIG. 6 illustrates a schematic view of the folded hydrotherapy treadmill 100, in accordance with an embodiment of the present invention. The folded hydrotherapy treadmill is a compact and versatile device that offers many benefits for individuals who need aquatic therapy. It is designed to provide a low-impact, high-resistance workout that can help improve cardiovascular health, strength, flexibility, and balance while minimizing stress on the joints. The device is easy to set up, adjust, and use, and can be folded for convenient storage and transportation. It also comes with various features such as adjustable water flow, speed, and temperature, making it customizable to meet the specific needs of different users. The folded hydrotherapy treadmill 100 is a versatile and practical tool for aquatic therapy and rehabilitation, allowing for safe and effective exercise in a limited space. The treadmill comprises a plurality of cavities in the treadmill belt and the base frame, wherein the plurality of cavities accommodates a plurality of closed cell foam pieces 620 configured to increase the buoyancy of the treadmill's main body. This helps in removing the treadmill from the pool easily with lesser effort as the closed cell foam piece 620 adds extra buoyancy to the treadmill's main body. A front portion of the base frame 610 comprises at least two wheels 420 configured to maneuver the hydrotherapy treadmill 100.

The utility model has the advantages that the structure is simple and the installation is convenient. Because the hydraulic motor is used for transmission, the underwater mechanical operation part has no electrical contact, which is safe and reliable. In one embodiment, a variable frequency motor controls the speed of the hydraulic vane pump to adjust the running speed smoothly and evenly. The use of hydraulic vane pumps greatly reduces the noise of conventional oil pumps, making the user more comfortable. Mechanical seals are used to protect the bearings, extending their life of the bearings while ensuring that the lubricant does not leak and does not contaminate the water.

The current design uses an AC motor with a 24-volt proportional control valve that adjusts the amount of hydraulic fluid flowing to the hydraulic motor or bypassing it back to the tank to control speed. There are other types of speed control valves that could possibly be used.

The hydraulic motor is loud, hence the present invention uses sound insulated power pack unit from the inside to reduce noise. While this is a safety factor in terms of hydraulic fluid leakage, it is economical to use non-corrosive materials and eliminate the waterproof enclosure. This also takes away the failure risk of a leaking enclosure.

Some of the non-limiting advantages of the present invention include:

1. Compatible with 120 V power supply. Hence, consumes less energy
2. Light weight and consumes less space
3. Less expensive
4. Requires a lesser number of people for installing and removing from a pool
5. Works with mobile power pack
6. User friendly Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

All publications, patent applications, patents, and other references mentioned in the specification are indicative of the level of those skilled in the art to which the presently disclosed subject matter pertains. All publications, patent applications, patents, and other references are herein incorporated by reference to the same extent as if each individual publication, patent application, patent, and other reference was specifically and individually indicated to be incorporated by reference. It will be understood that, although a number of patent applications, patents, and other references are referred to herein, such reference does not constitute an admission that any of these documents forms part of the common general knowledge in the art. Although the foregoing subject matter has been described in some detail by way of illustration and example for purposes of clarity of understanding, it will be understood by those skilled in the art that certain changes and modifications can be practiced within the scope of the appended claims.

The invention claimed is:

1. A hydrotherapy treadmill, the treadmill comprising:

a treadmill main body including a treadmill belt, submerged in a water body, mounted on a support rack having a first and a second longitudinal side rails;

a base frame configured to mount the support rack and the treadmill belt;

a plurality of watertight cavities in the treadmill belt and the base frame configured to increase the buoyancy of the treadmill main body:

a first roller and a second roller rotatably mounted on the support rack and positioned between and substantially perpendicular to said first and second longitudinal side rails, wherein the treadmill belt is an endless belt mounted around and extending between the first roller and the second roller for rotation therewith;

a transmission system comprising:

i) an electrically powered hydraulic pump, wherein the electrically powered hydraulic pump rotates a hydraulic motor of the treadmill belt via a hydraulic input hose and a hydraulic output hose connected to the treadmill main body; and ii) wherein the hydraulic pump is powered by plugging, into a 120-volt power supply, a cord of a portable power unit mounted on a rolling cart.

2. The hydrotherapy treadmill as claimed in claim 1, wherein the main body of the treadmill is configured to fold into a portable configuration.

3. The hydrotherapy treadmill as claimed in claim 1, wherein a front portion of the base frame comprises at least two wheels configured to maneuver the hydrotherapy treadmill.

4. The hydrotherapy treadmill as claimed in claim 1, comprises a plurality of cavities in the treadmill belt and the base frame, wherein the plurality of cavities accommodates a plurality of closed cell foam pieces configured to increase the buoyancy of the treadmill main body.

5. The hydrotherapy treadmill as claimed in claim 1, comprises a tether having the hydraulic input hose and the hydraulic output hose connected to the treadmill main body and a sensor cable connected to a processor configured to measure the speed of a user running on the hydrotherapy treadmill.

6. The hydrotherapy treadmill as claimed in claim 5, wherein the length of the tether ranges between 20-60 feet.

7. The hydrotherapy treadmill as claimed in claim 5, wherein the sensor cable at one end comprises a hall effect sensor in communication with a ring having a magnetic outer shell that is fixed to a rotating shaft of the hydraulic motor of the treadmill belt.

8. The hydrotherapy treadmill as claimed in claim 5, wherein the sensor cable at one end comprises an inductive sensor in communication with a ring having a magnetic outer shell that is fixed to a rotating shaft of the hydraulic motor of the treadmill belt.

9. The hydrotherapy treadmill as claimed in claim 1, wherein the hydraulic motor is positioned inside a waterproof enclosure.

10. The hydrotherapy treadmill as claimed in claim 1, wherein the hydraulic motor is made of non-corrosive materials selected from the group consisting of stainless steel, Aluminum, polypropylene and plastic.

11. The hydrotherapy treadmill as claimed in claim 1, wherein the first roller and the second roller rotatably mounted on the support rack are movably connected with a gear arrangement of the hydraulic motor configured to rotate the treadmill belt.

12. The hydrotherapy treadmill as claimed in claim 1, wherein the main body of the treadmill has a footprint of 32 inches×46 inches.

13. The hydrotherapy treadmill as claimed in claim 1, wherein the rolling cart of the portable power unit comprises a plurality of casters and a handle to maneuver the rolling cart.

14. The hydrotherapy treadmill as claimed in claim 1, wherein the rolling cart of the portable power unit comprises a hydraulic fluid reservoir for the hydraulic pump.

15. The hydrotherapy treadmill as claimed in claim 1, wherein the hydraulic pump is a hydraulic vane pump.

16. The hydrotherapy treadmill as claimed in claim 1, wherein the main body of the treadmill comprises a plurality of control buttons and safety stop buttons for the user running on the hydrotherapy treadmill.

17. The hydrotherapy treadmill as claimed in claim 1, wherein the treadmill is operated using a plurality of pneumatic air switches and tubing at the treadmill main body.

18. The hydrotherapy treadmill as claimed in claim 1, wherein the treadmill is operated using a Bluetooth wireless controller at the treadmill main body.

19. The hydrotherapy treadmill as claimed in claim 1, comprises a safety feature configured to prevent the hydraulic motor being turned on, if either of the hydraulic input hose and the hydraulic output hose are not connected.

20. The hydrotherapy treadmill as claimed in claim 1, comprises a plurality of switches positioned inside a waterproof enclosure, wherein the plurality of switches are powered by a small battery and are in communication with a control unit via Bluetooth signals.

* * * * *